United States Patent [19]

Batca

[11] Patent Number: 4,932,654

[45] Date of Patent: Jun. 12, 1990

[54] MULTI-PURPOSE EXERCISE BENCH

[76] Inventor: Roger B. Batca, 3102 Shaftsbury Dr., Durham, N.C. 27704

[21] Appl. No.: 209,961

[22] Filed: Jun. 22, 1988

[51] Int. Cl.[5] ..... A63B 21/06

[52] U.S. Cl. ..... 272/117; 272/118

[58] Field of Search ..... 272/117, 118, 142, 144, 272/93

[56] References Cited

U.S. PATENT DOCUMENTS 4,236,712 12/1980 Lambert, Jr. ..... 272/118

4,753,437 6/1988 Lapcevic ..... 272/117

*Primary Examiner*—Stephen R. Crow

[57] ABSTRACT

This invention relates to a multi-purpose exercise bench. The bench has been described showing the essential parts which comprise a frame, a pulley system attachment, a seat adjusting assembly, and a seated row/curl attachment. The improvements comprise a carriage for the pulley system attachment, a seat adjusting sleeve assembly which slides through the midsection of the frame, and a seated row/curl attachment which is adjusted onto the seat adjusting sleeve assembly and the pulley system attachment.

3 Claims, 7 Drawing Sheets

MULTI-PURPOSE EXERCISE BENCH

SUMMARY OF THE INVENTION

This invention is a multi-purpose exercise bench. It is intended to be useful in the promotion of human wellness by aiding in enhancement of muscular development of the user. The bench is comprised of structural steel tubing, round pipe and bar, flat plate, nuts, bolts, washers, pulleys, cable, cable crimps, adjustable pins, vinyl, foam, staples, thumbscrews, and plastic cap inserts.

DESCRIPTION OF THE PREFERRED EMBODIMENTS

Figure 1:
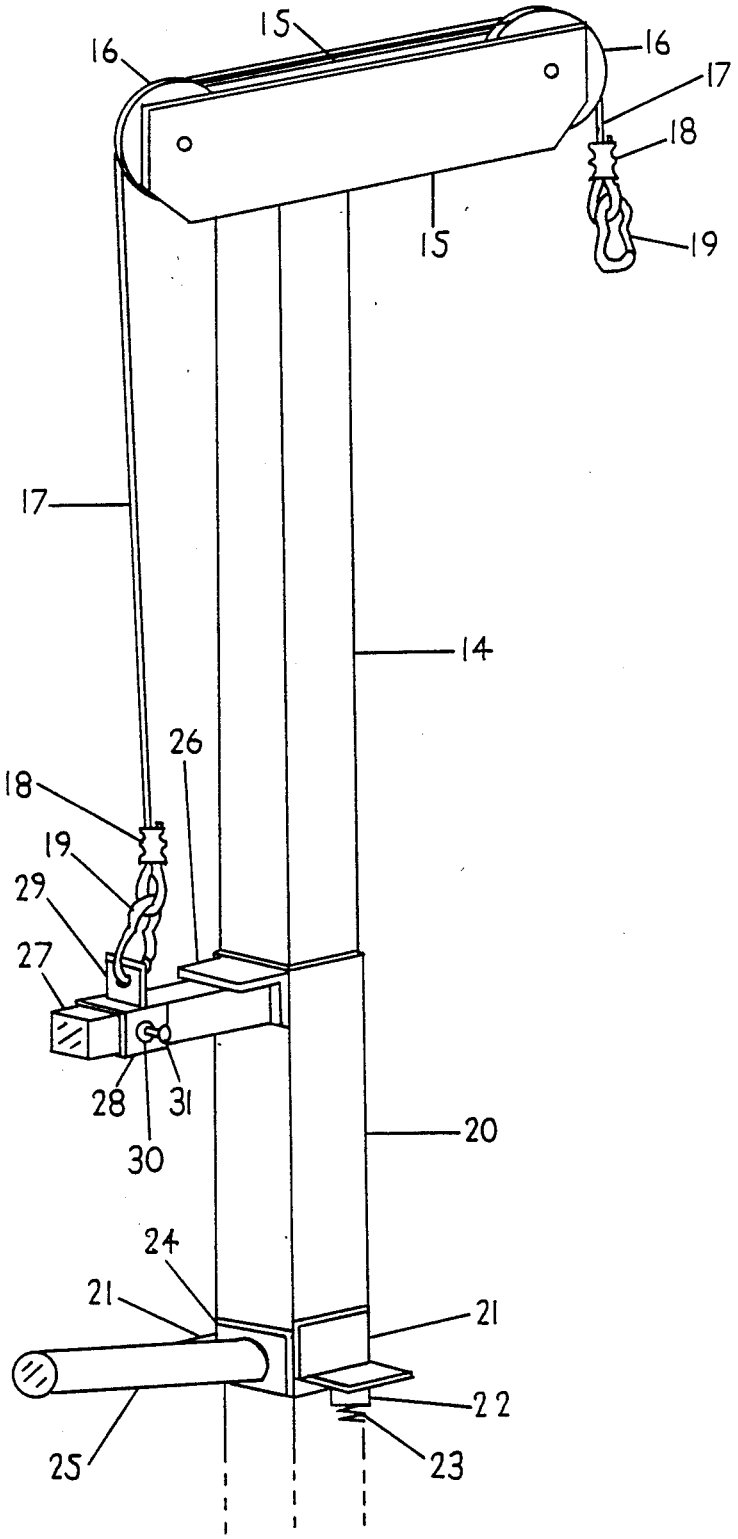
FIG. 1 is a perspective view of a weight hoisting carriage of the present invention.
Figure 2:
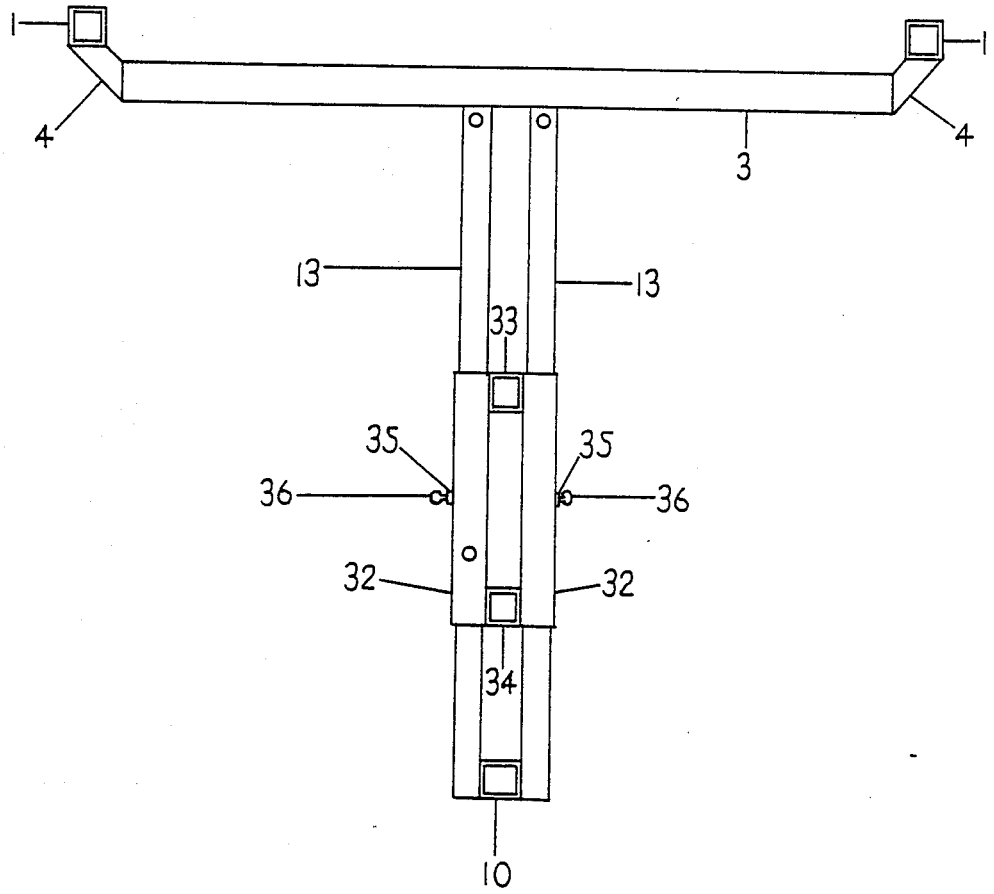
FIG. 2 is a top view of an exercise bench.
Figure 3:
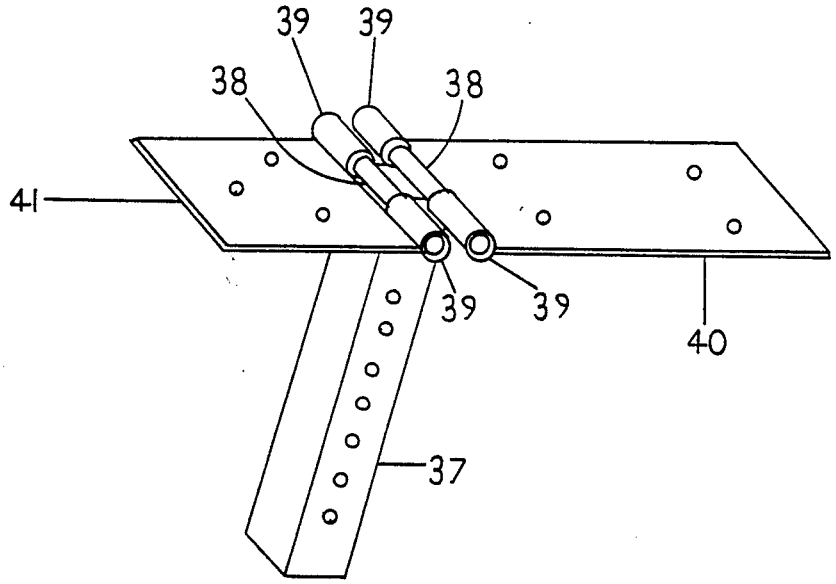
FIG. 3 is a perspective view of an adjustable seat assembly.
Figure 4:
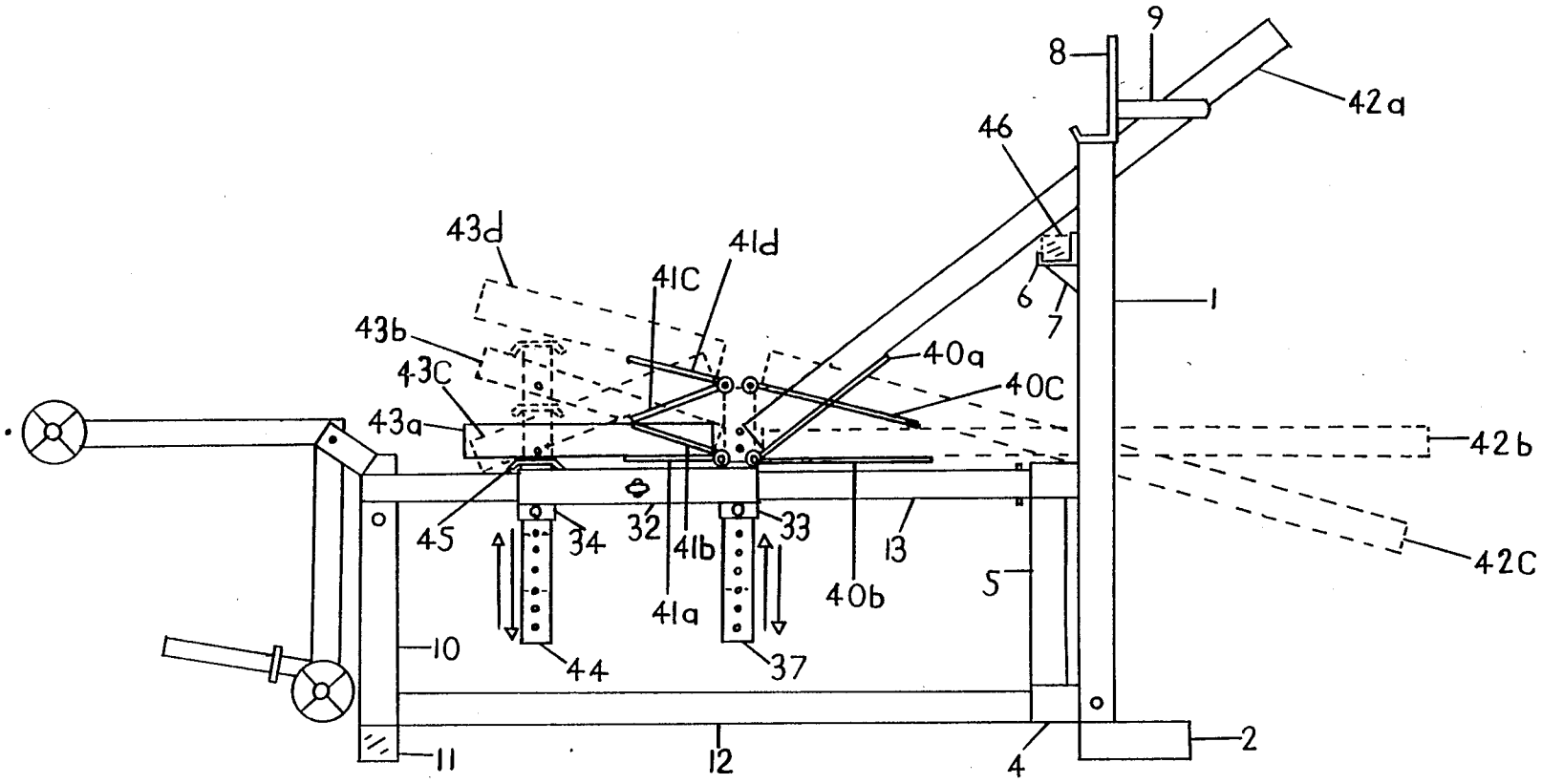
FIG. 4 is a side view of the exercise bench with the seat assembly.
Figure 5:
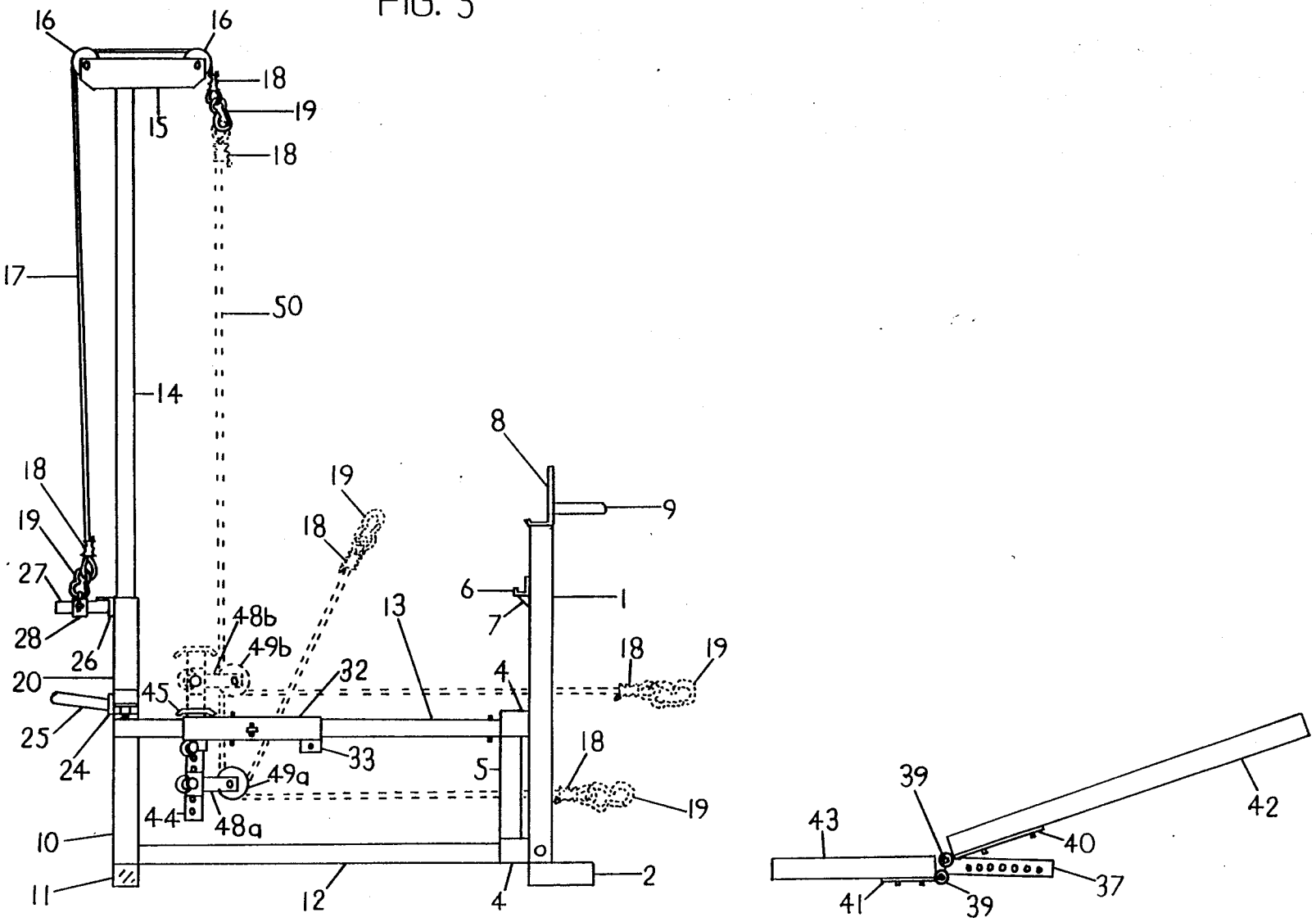
FIG. 5 is a side view of the exercise bench with a pulley system.
Figure 6:
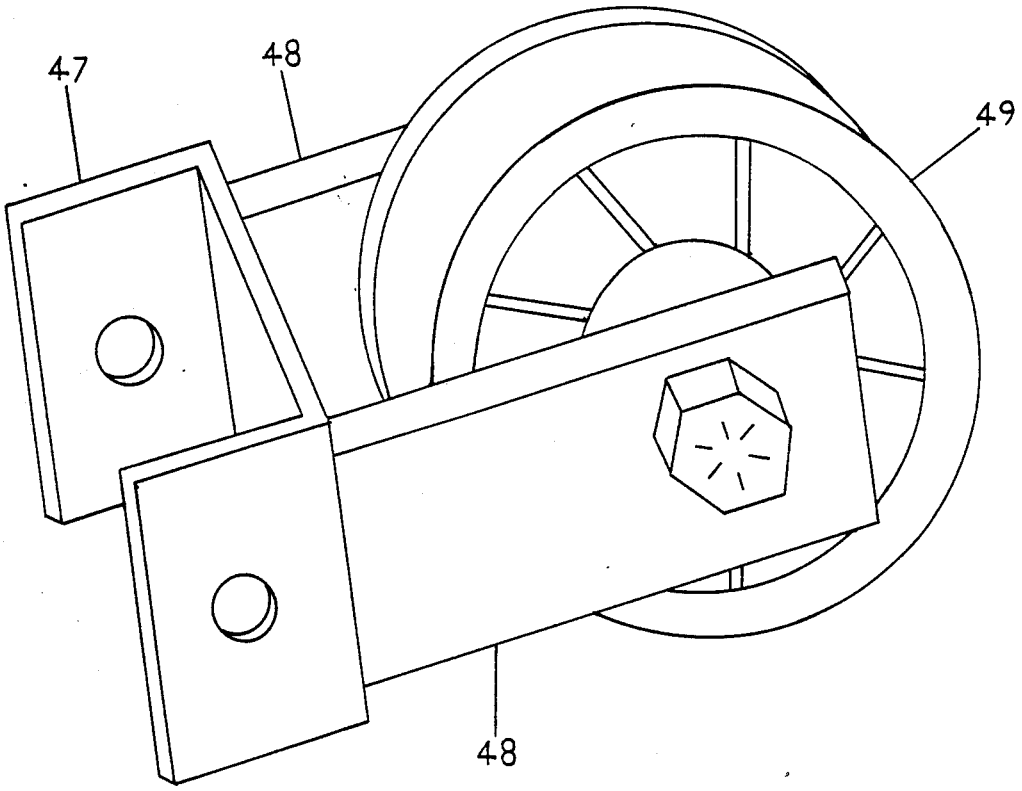
FIG. 6 is a perspective view of a pulley.
Figure 7:
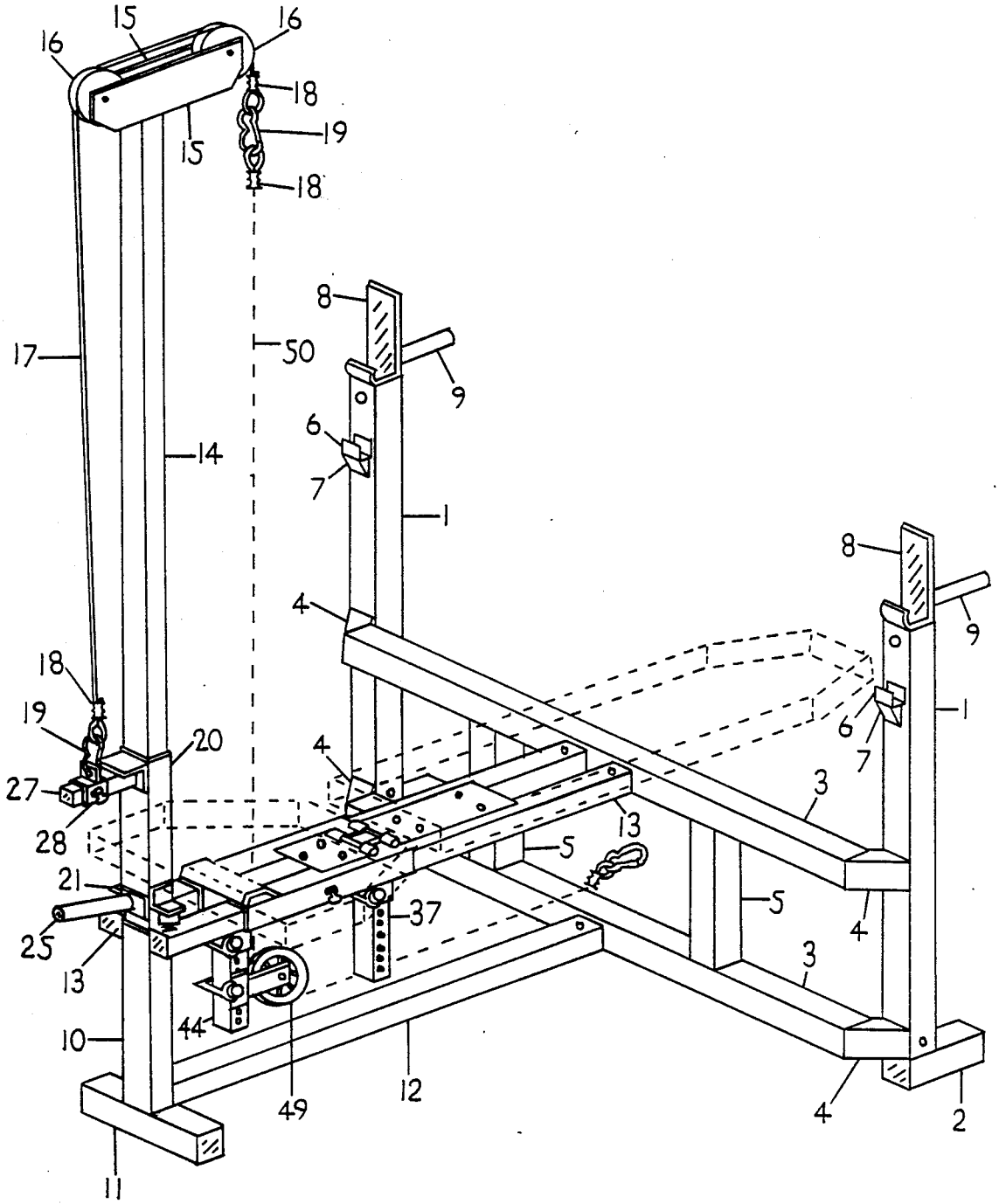
FIG. 7 is a perspective view of the exercise bench with the weight hoisting carriage, seat assembly, and pulley system.

An improved exercise bench of the type having:

(a) an elongated bench frame comprising:

(1) a head section having two vertical posts (1), each having first and second ends. Small foundations (2) are underneath each said second end. Upper and lower horizontal supports (3), each being adjoined at respective ends by 45 degree supports (4), adjoin said vertical posts (1) generally midway between said first and second ends and at the second ends. Two vertical supports (5) adjoin said horizontal supports (7) are affixed to said first ends of said vertical posts (1). Weight brackets (8) which slide vertically in and out of said vertical posts (1) support barbells and allow for a plurality of exercises. Handles (9) adjoined to a backside of said weight brackets (8) allow said user to perform dip exercises.

(2) a foot section having a vertical post (10), first and second ends, and a small foundation (11) underneath said second end.

(3) a midsection has a horizontal bar (12) adjoined at said second end of said vertical post (10) at said foot section and midway of the lower horizontal support (3) at said head section. Two generally smaller horizontal parallel bars (13) are adjoined respectively at opposite sides at said first end of said vertical post (10), at said foot section, and generally midway of the upper horizontal support (3) at said head section.

(b) a pulley system comprising:

(1) a post (14), having first and second ends, in which the said second end slides and rests inside the vertical post (10) at said foot section of said exercise bench. Two parallel plates (15) are adjoined respectively at opposite sides of said first end of post (14). Two pulleys (16) on each respective side of said post (14) are adjoined between the two said parallel plates (15).

(2) a cable (17) of variable effective length, having first and second ends, passing through said pulleys (16), each respective end having hookups consisting of cable crimps (18) and adjustable pins (19). The first end of said cable (17) allows for a plurality of separate attachments for persons exercising on said bench. The second end of said cable (17) allows for connection to a weighted carriage.

(3) an improved carriage comprising:

a. a sleeve (20), having first and second ends, mounted through said post (14);

b. two spring angle braces (21) adjoined respectively at opposite sides at said second end of said sleeve (20);

c. spring holders (22) adjoined and centered underneath said angle braces (21);

d. springs (23) affixed inside said spring holders (22);

e. a plate (24) adjoined at said second end of said sleeve (20) at opposite side of said bench frame;

f. a slightly upwardly angled weight mounting bar (25) adjoined and centered on said durability plate (24);

g. a hoist angle brace (26) adjoined at said first end of said sleeve (20) at the opposite side of said bench frame;

h. a hoist bar (27) adjoined and centered on said angle brace (26);

i. a weight control sleeve (28) mounted through said hoist bar (27);

j. a weight control sleeve link (29) adjoined and centered at the top of said weight control sleeve (28);

k. a weight control sleeve nut (30) adjoined and centered at one respective side of said weight control sleeve (28);

l. a weight control thumbscrew (31) for fastening the control sleeve nut (30) to the hoist bar (27).

Advantages of the improved carriage:

1. The weight is mounted on opposite sides of said bench frame onto said angled weight mounting bar (25) thus allowing maximum room for said user on said bench. On prior art carriages, the weight mounting bar is transverse to the bench on the user's side of bench thus crowding exercise movements.

2. On prior art carriages, weights are to be added onto either side or both sides of the weight mounting bar. If equal amounts of free weights are not on both opposite sides, there is a tendency for increased friction on the sides of the sleeve during the carriage's upward and downward movement over the pulley system post during the user's performance. On said improved carriage, weight is mounted on said angled weight mounting bar (25) thus always having equal weight on opposite respective sides. As more weight is mounted on said angled weight mounting bar (25), the weight mounting sleeve (28) can be adjusted to minimize friction on other opposite respective sides of said improved carriage during user preformance.

3. On said improved carriage, said springs (23) are provided on respective sides to minimize shock when weighted and the carriage returns to the original position after each user performance.

(c) an improved seat adjusting assembly comprising:

(1) two horizontal sliding sleeves (32), each having first and second ends, mounted through said horizontal parallel bars (13) at said midsection frame;

(2) a vertical seat sleeve (33) adjoined between said horizontal sleeves (32) at said first ends;

(3) a vertical seat/row sleeve (34) adjoined between said horizontal sliding sleeve (32) at said second ends;

(4) two nuts (35) adjoined and centered on opposite outside respective sides of said horizontal sliding sleeves (32);

(5) two thumbscrews (36) for fastening the sliding sleeves (32) onto the parallel bars (13) for adjustment purposes;

(6) a seat bar (37), having first and second ends, is mounted through said vertical seat sleeve (33) with the second end in a lower position;

(7) two seat bar rods (38) are adjoined and centered transverse to said horizontal parallel bars (13) at said first end of said seat bar (37);

(8) four seat bar rod sleeves (39) mounted flush on outer sides of said seat bar rods (38);

(9) an upper seat plate (40) adjoined to the two said seat bar rod sleeves (39) nearest to said head section of said exercise bench;

(10) a lower seat plate (41) adjoined to the two said seat bar rod sleeves (39) nearest to said foot section of said exercise bench;

(11) an upper bench seat (42) affixed to said upper seat plate (40);

(12) a lower bench seat (43) affixed to said lower seat plate (40);

(13) a seat/row bar (44), having first and second ends, is mounted through said vertical seat/row sleeve (34) with the second end in a lower position;

(14) an angled seat brace (45) adjoined transverse to said horizontal parallel bars (13), at said first end of said seat/row bar (44).

Advantages of the improved seat adjusting sleeve assembly:

1. The bench seat assembly can be completely removed by sliding assembly out of said vertical seat sleeve (33). The bench seat assembly can be positioned on a floor for sitting purposes by said user during a plurality of exercises.

2. The vertical seat sleeve (33), vertical seat/row sleeve (34), seat/row bar (44), angled seat brace (45), seat bar (37), seat bar rods (38), seat bar rod sleeves (39), upper seat plate (40), lower seat plate (41) and affixed bench seats (42) (43) allow vertical type swivel accessibility for both said bench seats (42) (43). Raising and lowering of said seat bar (37) and said seat/row bar (44), and support from a crossbar (46) resting in said safety brackets (6), allow for a plurality of said bench seats (42) (43) positions thus producing a plurality of inclinable and declinable positions thus enhancing the degree of exercise performed by the user and reducing risk of injury to the user.

3. The horizontal sliding sleeves (32), nuts (35), and thumbscrews (36) allow horizontal type accessibility for both said bench seats (42) (43). Horizontal movement of said horizontal sliding sleeves (32) across said horizontal parallel bars (13) allows for a plurality of horizontal positions for said bench seats (42) (43) thus enhancing the exercise performed by said user and reducing risk of injury to said user, whereby, the improved seat adjusting sleeve assembly allows said user total freedom of horizontal and vertical positioning of said bench seats (42) (43) for any one of a plurality of different exercises for many different body parts of said user, thus enhancing the degree of motion during exercise by said user thus reducing risk of injury of said user, (d) a seated row/curl attachment comprising:

(1) a "u" shaped adjusting angle (47) used for adjustments along said seat/row bar (44);

(2) two parallel plates (48) adjoined and centered on said adjusting angle (47) allowing variable effective distance between for row/curl pulley (49);

(3) a cable (50) of variable effective length, having first and second ends, passing through said row/curl pulley (49), each respective end having hookups consisting of cable crimps (18) and adjustable pins (19).

Advantage of seated row/curl attachment:

1. The seated row/curl attachment can be adjusted to a plurality of positions, with the aid of a pin, along said seat/row bar (44). The seat/row bar (44) can be positioned above or below said horizontal sleeves (32) by sliding up and down the said vertical seat/row sleeve (34), thus allowing said user to predetermine and affix said row/curl pulley (49) at the position desired in order to maximize the degree of motion desired during performance, thus enhancing the exercise motion and decreasing risk of injury, especially injury to the lower back of the user.

I claim:

1. An exercise bench having an improved carriage apparatus for hoisting weights comprising an exercise bench, and a carriage apparatus which comprises:

(a) a carriage having:

(1) a sleeve which slides up and down a pulley system post during user performance;

(2) a pair of spring angle braces, each being affixed at bottom opposite sides of said carriage sleeve;

(3) a pair of spring holders, each being affixed underneath each said spring angle brace;

(4) a pair of springs, each being affixed inside spring holders which greatly reduce the shock of impact when said carriage sleeve returns to said exercise bench after said user performance;

(5) a durability plate affixed at the bottom of said carriage sleeve;

(6) a weight mounting bar affixed on said durability plate facing away from the upper side of said exercise bench in order to mount weight plates at a fixed position which is transverse to said weight mounting bar;

(7) a hoist angle brace affixed at the top of said carriage sleeve;

(8) a hoist bar affixed on said angle brace at the top of said carriage sleeve on the same side of said carriage sleeve as the weight mounting bar which serves as a foundation for hoisting said carriage sleeve during said user performance;

(b) a weight control sleeve having:

(1) a sleeve mounted through said hoist bar which is to be adjusted by said user in accordance with the amount of free weight added to said weight mounting bar for reducing friction between said carriage and a pulley system attachment post during vertical hoisting, thus enabling smooth movement by said user during performance;

(2) a weight control sleeve link affixed on the top of said weight control sleeve for attachment with one end of the hoisting cable which channels over a pulley system, thus enabling said user to perform a plurality of exercises with a plurality of different attachments; and (3) a thumbscrew and nut assembly affixed on said weight control sleeve to aid in adjustment of said weight control sleeve.

2. The exercise bench of claim 1 further comprising an improved seat adjusting sleeve assembly which comprises:

(a) a horizontal and vertical sleeve assembly having:

(1) a pair of horizontal sleeves each sliding though a midsection of said exercise bench;

(2) a vertical seat sleeve affixed between said horizontal sleeves at ends nearest to the head section of said exercise bench;

(3) a vertical seat/row sleeve affixed between said horizontal sleeves at ends nearest to the foot section of said exercise bench; and (4) a thumbscrew and nut assembly affixed on said horizontal sleeves to aid in adjustment of said horizontal sleeves; and (b) a seat/row bar assembly having:

(1) a seat/row bar which can slide up and down vertically with adjustment means through said vertical seat/row sleeve; and (2) an angled seat brace affixed at the top of said seat/row bar; and (c) a seat adjusting assembly having:

(1) a seat bar which can slide up and down vertically with adjustment means through said vertical seat sleeve;

(2) a pair of seat bar rods affixed at the top of said seat bar;

(3) four seat bar rod sleeves which slide along said seat bar rods;

(4) an upper seat plate affixed to the two said seat bar rod sleeves nearest to the head section of said exercise bench;

(5) a lower seat plate affixed to the two said seat bar rod sleeves nearest to the foot section of said exercise bench;

(6) a lower bench seat affixed on said lower seat plate; and (7) an upper bench seat affixed on said upper seat plate, whereby said improved seat adjusting sleeve assembly having a plurality of inclinable and declinable positions, whereby positions can be predetermined by said user by adjusting any one or a combination of the said seat bar, the seat/row bar, and/or the said horizontal sleeves.

3. The exercise bench of claim 1 further comprising a seated row/curl assembly having:

(a) an adjusting pulley attachment having:

(1) a channel type angle which is used for adjustment means along said seat/row bar;

(2) a pair of plates affixed on said channel type angle;

(3) a pulley affixed between two said plates; and (b) a cable of variable effective length passing through said pulley with one end of said cable connected to the other cable end on said pulley system attachment with the other end of said cable being connectable to any one of a plurality of separate exercise bench attachment bars, whereby said user can pre-select the position of said pulley by adjusting said seated row/curl assembly to any one of a plurality of positions along said seat/row bar.

* * * * *